US012258234B2

(12) United States Patent
Chun et al.

(10) Patent No.: US 12,258,234 B2
(45) Date of Patent: Mar. 25, 2025

(54) ROLL UNWINDING CRADLE

(71) Applicant: Brown LLC, Beaverton, MI (US)

(72) Inventors: Victor L. Chun, Beaverton, MI (US); Robert Abel, Beaverton, MI (US)

(73) Assignee: BROWN LLC, Beaverton, MI (US)

( * ) Notice: Subject to any disclaimer, the term of this patent is extended or adjusted under 35 U.S.C. 154(b) by 0 days.

(21) Appl. No.: 18/606,131

(22) Filed: Mar. 15, 2024

(65) Prior Publication Data

US 2024/0343516 A1 Oct. 17, 2024

Related U.S. Application Data

(60) Provisional application No. 63/496,527, filed on Apr. 17, 2023.

(51) Int. Cl.
*B65H 16/08* (2006.01)
*B65H 16/10* (2006.01)

(52) U.S. Cl.
CPC ..... *B65H 16/08* (2013.01); *B65H 16/106* (2013.01)

(58) Field of Classification Search
CPC ..... B65H 16/08; B65H 16/106
See application file for complete search history.

(56) References Cited

U.S. PATENT DOCUMENTS 5,657,945 A * 8/1997 Bryant ..... B65H 19/12 242/595.1
5,947,408 A * 9/1999 Miyake ..... B65H 19/105 242/562
7,380,747 B2 * 6/2008 Fromm ..... A61F 13/15804 242/563.2
7,438,252 B2 * 10/2008 Kusel ..... B65H 18/025 242/542.3
2016/0136980 A1 5/2016 Kobayashi et al.
2018/0222225 A1 8/2018 Suzuki et al.
2021/0053786 A1 * 2/2021 Wang ..... B65H 23/1825
2023/0008774 A1 1/2023 Chun et al.

FOREIGN PATENT DOCUMENTS

CN 212555213 2/2021
KR 20140117172 10/2014

OTHER PUBLICATIONS

International Search Report and Written Opinion in related PCT Application PCT/US2024/020718 mailed Jul. 31, 2024, 18 pages.

* cited by examiner

*Primary Examiner* — Sang K Kim
(74) *Attorney, Agent, or Firm* — HOVEY WILLIAMS LLP

(57) ABSTRACT

An apparatus for unwinding a roll of material includes an unwinding roller, an idle roller, and a motor. The unwinding roller is for supporting the roll of material. The idle roller is spaced apart from the unwinding roller so that the roll of material can be supported on the idle roller and the unwinding roller. The motor is in mechanical communication with the unwinding roller and is configured to axially rotate the unwinding roller.

5 Claims, 2 Drawing Sheets

ROLL UNWINDING CRADLE

CROSS-REFERENCE TO RELATED APPLICATIONS

The current patent application is a non-provisional utility patent application which claims priority benefit, with regard to all common subject matter, of earlier-filed U.S. Provisional Application Ser. No. 63/496,527; entitled "ROLL UNWINDING CRADLE"; and filed Apr. 17, 2023. The Provisional Application is hereby incorporated by reference, in its entirety, into the current patent application.

BACKGROUND

There are generally two categories of equipment used to unwind a roll of plastic or paper. One category involves core chucks and an arbor shaft installed on the core of the roll. The arbor shaft is rested on bearings. The web is then pulled with a set of motorized pinch rollers. Rolls often weigh up to about 1,800 kilograms (or about 4,000 pounds) and therefore the tension to pull the web from the roll is high. This high tension can be detrimental to thin materials and cause manufacturing disruptions or malfunctions. For example, the roll may tend to continue to rotate to cause the thin web material to bundle up. This then requires a controllable magnetic powder brake on the arbor shaft. Another category of equipment includes motorized chucks that are clamped to the core of the roll. A means of monitoring the web linear speed is needed to feed back to a motion controller to modulate a driving chuck rotational speed. This involves expensive devices and a sophisticated motion controller.

The background discussion is intended to provide information related to the present invention which is not necessarily prior art.

SUMMARY OF THE INVENTION

The present invention solves the above-described problems and other problems by providing apparatuses, systems, and methods for unrolling a roll of material without the use of chucks, arbor shafts, or expensive and complicated systems having feedback loops.

An apparatus constructed according to an embodiment of the present invention includes an unwinding roller, an idle roller, and a motor. The unwinding roller is for supporting the roll of material. The idle roller is spaced apart from the unwinding roller so that the roll of material can be supported on both the idle roller and the unwinding roller. The motor is in mechanical communication with the unwinding roller and is configured to axially rotate the unwinding roller.

Another embodiment of the invention is a system for unwinding a roll of material. The system includes an unwinding roller, an idle roller, a first motor, a pull roller, a second motor, a pinch roller, and a biasing element. The unwinding roller is for supporting the roll of material. The idle roller is spaced apart from the unwinding roller so that the roll of material can be supported on the idle roller and the unwinding roller. The first motor is in mechanical communication with the unwinding roller and is configured to axially rotate the unwinding roller. The pull roller is operable to rotate to pull material from the roll of material. The second motor is in mechanical communication with the pull roller and is configured to cause the pull roller to rotate. The pinch roller is operable to rotate with the pull roller. The biasing element is configured to maintain pressure between the pinch roller and the pull roller.

Another embodiment of the invention is a method of unwinding a roll of material. The method includes directing, via a controller, a first motor to operate at a predetermined speed so that first motor causes an unwinding roller to rotate axially, the unwinding roller being spaced apart from an idle roller with the roll of material positioned on the idle roller and the unwinding roller; and directing, via the controller, a second motor to operate at a desired torque so that the second motor causes a web tensioner to pull the material from the roll of material.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
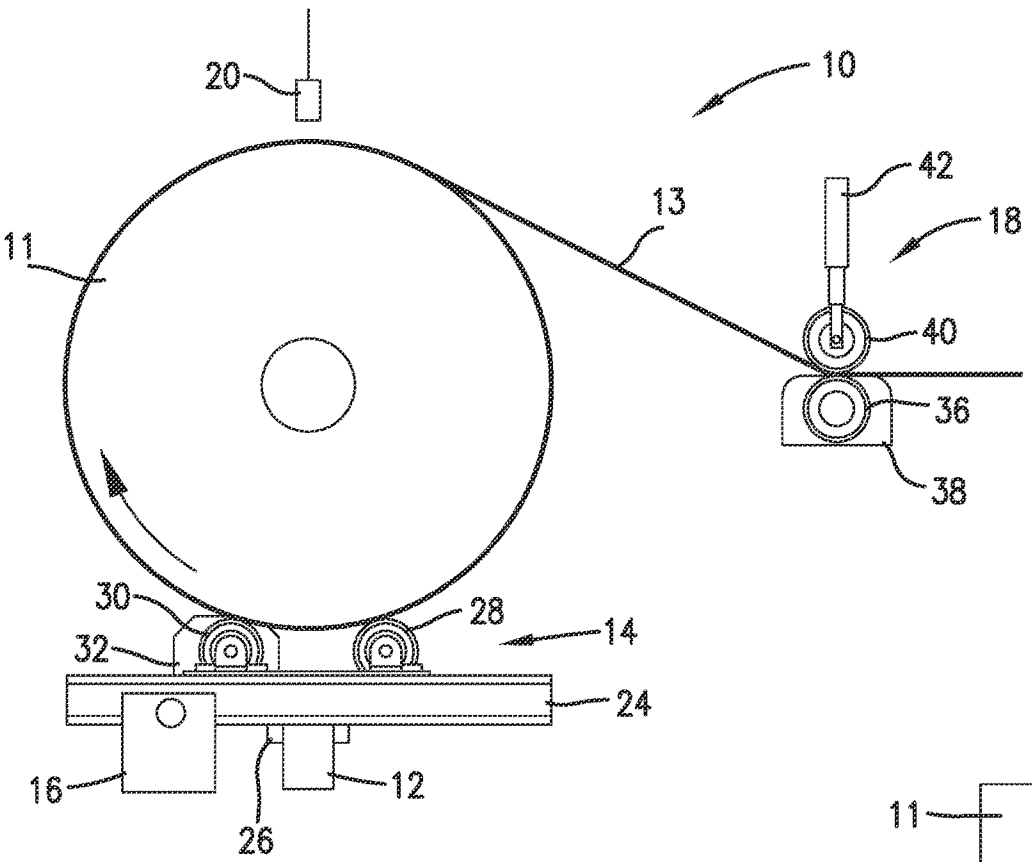
FIG. 1 is a schematic side view of a system for unrolling a roll of material constructed in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

Turning to FIG. 1, a system 10 for unwinding a roll of material 11 is depicted. The roll of material 11 may comprise paper, plastic, or the like. The system 10 comprises a track 12, a cradle assembly 14 movably secured to the track 12 and configured to cradle the roll of material 11, an actuator 16 configured to shift the cradle assembly 14 along the track 12, a web tensioner assembly 18 configured to pull material 13 from the roll of material 11, a sensor 20 configured to detect a metric associated with the roll of material 11, and a controller 22 (depicted in FIG. 3) configured to receive signals from the sensor 20 and control the cradle assembly 14, the actuator 16, and the web tensioner 18.

Figure 2:
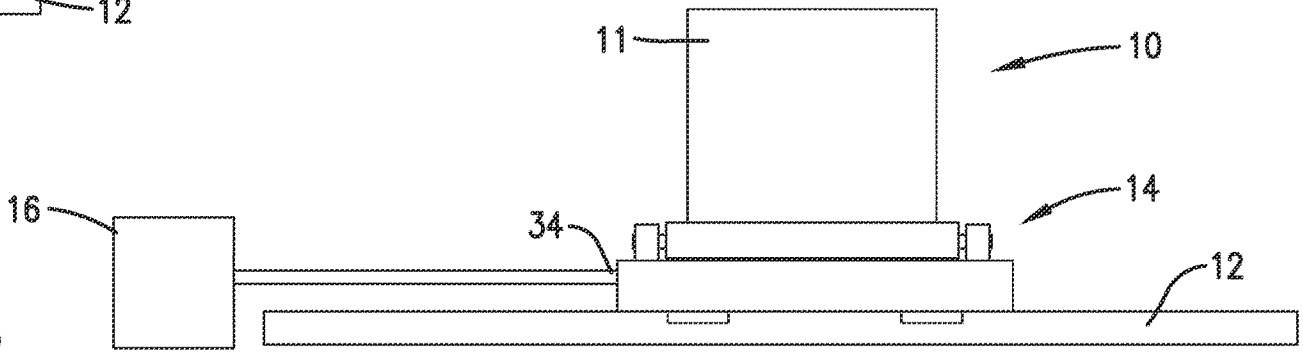
FIG. 2 is a schematic front view of a cradle assembly, a track, and an actuator of the system of FIG. 1.

The track 12 may comprise one or more surfaces on which the cradle assembly 14 is movably secured, such as a rail or the like. The track 12 extends in a direction generally parallel to the axis of the roll of material 11 and/or the axes of the rollers of the cradle assembly 14 (discussed in further detail below), as depicted in FIG. 2. This enables the cradle assembly 14 to readily align the roll of material 11 with a production line.

Turning back to FIG. 1, the cradle assembly 14 is movably secured to the track 12 and is configured to cradle the roll of material 11. In one or more embodiments, the cradle assembly 14 is configured to support all the weight of the roll of material 11. In other words, the cradle assembly 14 is configured to support the roll of material 11 without the help of a core chucks, arbor shafts, or the like engaging the core of the roll of material 11. The cradle assembly 14 comprises a platform 24, one or more linear bearing 26, one or more idle roller 28, one or more unwinding roller 30, and one or more motor 32. The platform 24 supports the rollers 28, 30 and is movably secured to the track 12 via the linear bearings 26.

The idle roller 28 and the unwinding roller 30 are spaced apart so that the roll of material 11 can be supported thereon. Specifically, the rollers 28, 30 engage outer surfaces of the roll of material 11 so that the roll 11 is cradled between the rollers 28, 30. The distance between the rollers 28, 30 may be wide enough to support large rolls of material yet narrow enough to prevent completely unwound or substantially unwound rolls from falling or binding between the rollers 28, 30. The rollers 28, 30 are rotatably secured to the platform 24 via bearings or the like. While the rollers 28, 30 are each depicted as single cylindrical rollers, the rollers 28, 30 may have any number of shapes or configurations without departing from the scope of the present invention. For example, the rollers 28, 30 one or more of the rollers 28, 30 may instead comprise a set of roller and belt assemblies, arrays of cylindrical or spherical bearings, or the like.

The motor 32 is in mechanical communication with the unwinding roller 30 and configured to cause the unwinding roller 30 to rotate axially. The motor 32 may be controlled by the controller 22 and/or an internal motor controller operable to maintain the motor 32 at a speed so that the material moves off the roll at a constant linear speed. As the unwinding roller 30 rotates due to the mechanical force provided by the motor 32, the roll of material 11 rotates about its axis. In one or more embodiments, the motor 32 is configured to cause the roll of material 11 to rotate without the help of any force applied to the central core of the roll of material 11 or central channel defined by the by roll of material 11 by, for example, a core chuck, an arbor shaft, or the like. The idle roller 28 is operable to freely rotate, thereby supporting the roll of material 11 and rotating with the roll of material 11 as it rotates.

While FIG. 1 depicts the rollers 28, 30 being in a certain configuration relative to the unwinding motion of the roll 11 indicated by the arrow, the rollers 28, 30 may be configured any number of ways without departing from the scope of the present invention. For example, the rollers 28, 30 may be swapped. Further, the system 10 may include any number of unwinding rollers and/or idle rollers without departing from the scope of the present invention.

The actuator 16 is configured to shift the cradle assembly 14 along the track. In one or more embodiments, the actuator 16 is a linear actuator, such as a pneumatic cylinder. However, the actuator 16 may be any type of actuator without departing from the scope of the present invention, such as a hydraulic actuator, a motor (such as a servomotor), or the like. In one or more embodiments, the actuator 16 is mounted at an end of the track 12 and the actuating end 34 (depicted in FIG. 2) is attached to the platform 24. However, the actuator 16 may be in any configuration without departing from the scope of the present invention. For example, the actuator 16 may alternatively be secured to the cradle assembly 14 and engage the track 12 in an embodiment where the actuator 16 is a motor. Alternatively, the actuator 16 may be mounted to the cradle assembly 14 with its actuating end 34 secured to a wall or object mounted to the floor. The actuator 16 may be controlled by the controller 22 to move the cradle assembly 14 along the track 12. Alternatively, the actuator 16 may be manually operated by a switch or the like.

The web tensioner assembly 18 is configured to pull material from the roll of material 11. The web tensioner assembly 18 comprises one or more series of rollers, pulleys, and/or belts that are used to pull material from the roll of material. The web tensioner assembly 18 may be controlled by the controller 22 to adjust the amount of tension applied to the material. In one or more embodiments, the web tensioner assembly 18 comprises a pull roller 36, motor 38, a pinch roller 40, and a biasing element 42. The pull roller 36 is operable to rotate to pull material 13 from the roll of material 11. The motor 38 is in mechanical communication with the pull roller 36 and is configured to cause the pull roller 36 to rotate. In one or more embodiments, the motor 38 is operable to maintain a desired torque on the material 13 pulled from the roll 11. The pinch roller 40 is operable to rotate with the pull roller, and the biasing element 42 is configured to maintain pressure between the pinch roller 40 and the pull roller 36 so that the web of material 13 is gripped and pulled. In one or more embodiments, the biasing element 42 comprises a spring, a pneumatic cylinder, a hydraulic cylinder, or the like. While FIG. 1 depicts the biasing element 42 pushing the pinch roller 40 toward the pull roller 36, the biasing element 42 may be configured any number of ways without departing from the scope of the present invention. For example, the biasing element 42 may be attached to the pull roller 36 and configured to pull the pinch roller 40 toward the pull roller 36.

The sensor 20 is configured to detect a metric associated with the roll of material 11. The metric may include or be associated with a dimension of the roll of material, the amount of material remaining on the roll, a weight of the roll of material, or a tension applied to the material. In one or more embodiments, the sensor 20 is a laser distance measuring sensor that measures a distance between the outer surface of the roll of material 11 and the sensor 20, which allows the controller 22 to determine a remaining amount of material on the roll 11. The sensor 20 may detect any number of metrics associated with the roll of material 11 without departing from the scope of the present invention. For example, the sensor 20 may comprise a transducer, such as a strain gauge or a pressure sensor, that is mounted to the cradle assembly 14, or the like.

Figure 3:
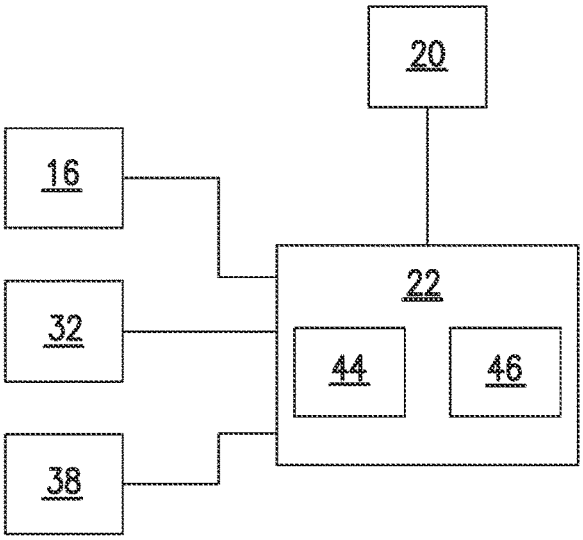
FIG. 3 is a block diagram depicting select components of the system of FIG. 1.

Turning to FIG. 3, the controller 22 is configured to receive signals from the sensor 20 and control the cradle assembly 14, the actuator 16, and the web tensioner assembly 18. The controller 22 comprises one or more processing element 44, such as a microcontroller, and one or more memory element 46. The controller 22 is configured to adjust the position of the cradle assembly 14 by sending one or more control signals to the actuator 16. The controller 22 is also configured to receive one or more signals from the sensor 20 representative of the metric associated with the roll of material 11, and based at least in part on that signal and/or metric, send one or more control signals to the motor 32 to adjust the speed of the motor 32 and send one or more control signals to the motor 38 to adjust the torque of the motor 38 and thereby adjust the tension applied by the web tensioner assembly 18 accordingly. In one or more embodiments, the controller 22 is configured to cause the motors 32, 38 to operate so that the material 13 being pulled from the roll moves at a constant linear speed. The controller 22 may also be configured to process the signal and/or the metric to determine a derivative or related metric. For example, the sensor 20 may provide a signal representative of a distance between the sensor 20 and the out surface of the roll 11. The controller 22 may be configured to determine a remaining amount of material on the roll 11, a weight of the roll 11, a rotational speed of the roll 11, a linear speed of the material 13 leaving the roll 11, or the like based at least in part on the distance.

Figure 4:
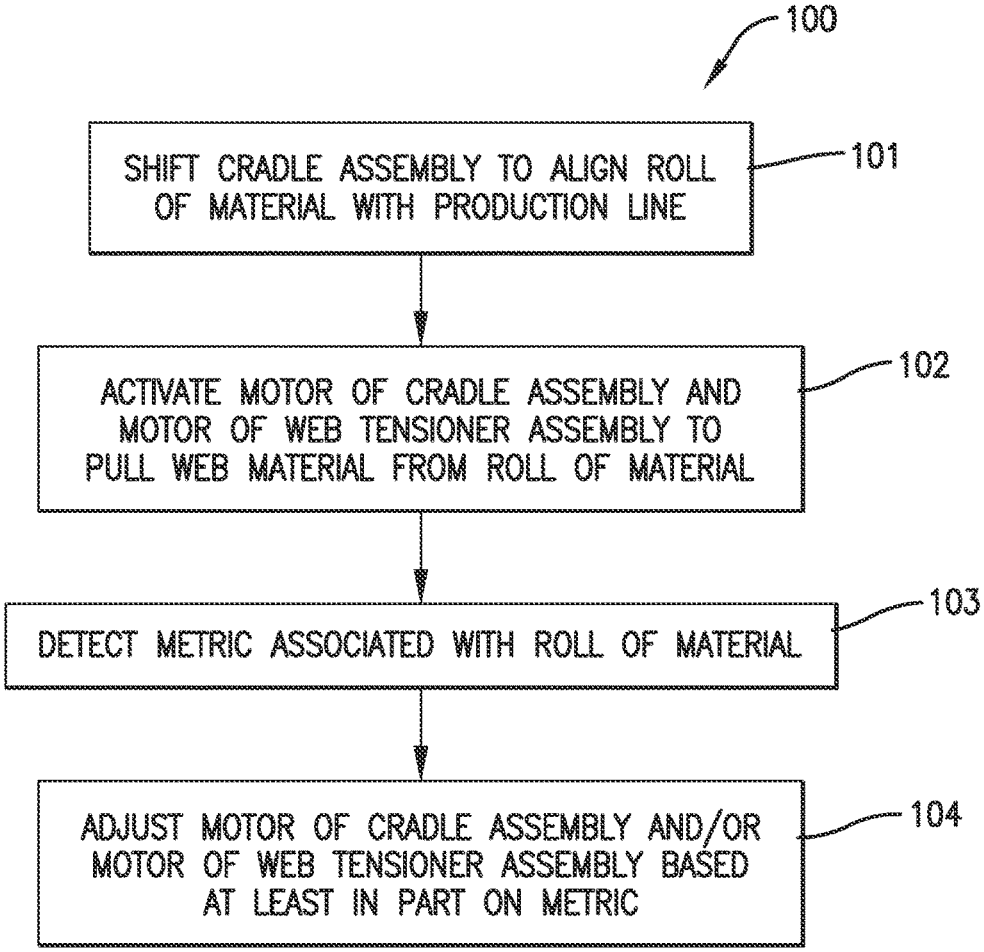
FIG. 4 is a flowchart depicting exemplary steps of a method according to an embodiment of the present invention.

The flow chart of FIG. 4 depicts steps of an exemplary method 100 of moving thermoformed products. The method 100 is described below, for ease of reference, as being executed by exemplary devices and components introduced with the embodiments illustrated in FIGS. 1-3. The steps of the method 100 may be performed by the controller 22 through the utilization of processors, transceivers, hardware, software, firmware, or combinations thereof. However, some of such actions may be distributed differently among such devices or other devices without departing from the spirit of the present invention. Control of the system may also be partially implemented with computer programs stored on one or more computer-readable medium(s). The computer-readable medium(s) may include one or more executable programs stored thereon, wherein the program(s) instruct one or more processing elements to perform all or certain of the steps outlined herein. The program(s) stored on the computer-readable medium(s) may instruct processing element(s) to perform additional, fewer, or alternative actions, including those discussed elsewhere herein.

Referring to step 101, the cradle assembly is shifted along the track to align the roll of material with the production line. The idle roller and unwinding roller may be shifted in directions parallel to their respective axes. In one or more embodiments, the cradle assembly is adjusted via the linear actuator. In such embodiments, this step may include directing or sending control signals, via the controller, to the actuator.

Referring to step 102, the motor of the cradle assembly and the motor of the web tensioner assembly are activated to cause the web material to be pulled from the roll of material. In one or more embodiments, this step may include directing, via the controller, the motor of the cradle assembly to operate at a predetermined speed so that the motor causes the unwinding roller to rotate axially. The speed of the motor may be adjusted to maintain the web material extending from the roll at a generally constant linear speed. In one or more embodiments, this step may also include directing, via the controller, the motor of the web tensioner assembly to maintain the web material at that generally constant linear speed. For example, this step may include directing, via the controller, the web tensioner assembly motor to operate to maintain a generally constant torque to pull the material from the roll while preventing bunching, tearing, or damaging the material.

Referring to step 103, a metric associated with the roll of material is detected via the sensor. In one or more embodiments, the metric is representative of a remainder of the material on the roll of material. For example, the metric is a distance between the sensor and an outer edge or surface of the roll of material.

Referring to step 104, the motor of the cradle assembly and/or the motor of the web tensioner assembly are adjusted based at least in part on the detected metric. In one or more embodiments, this step includes receiving, via the controller, a signal representative of the metric. This step may further include determining, via the controller, a remaining amount of material on the roll based at least in part on the metric. Additionally or alternatively, this step may include determining, via the controller, a linear speed of the material unwinding from the roll.

The method 100 may include additional, less, or alternate steps and/or device(s), including those discussed elsewhere herein. For example, the step of measuring a metric associated with the roll of material may be performed prior to and/or during the step of activating the motors of the cradle and web tensioner assemblies.

Additional Considerations

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claims set forth in any subsequent regular utility patent application. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of routines, subroutines, applications, or instructions. These may constitute either software (e.g., code embodied on a machine-readable medium or in a transmission signal) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as computer hardware that operates to perform certain operations as described herein.

In various embodiments, computer hardware, such as a processing element, may be implemented as special purpose or as general purpose. For example, the processing element may comprise dedicated circuitry or logic that is permanently configured, such as an application-specific integrated circuit (ASIC), or indefinitely configured, such as an FPGA, to perform certain operations. The processing element may also comprise programmable logic or circuitry (e.g., as encompassed within a general-purpose processor or other programmable processor) that is temporarily configured by software to perform certain operations. It will be appreciated that the decision to implement the processing element as special purpose, in dedicated and permanently configured circuitry, or as general purpose (e.g., configured by software) may be driven by cost and time considerations.

Accordingly, the term "processing element" of the controller 22 or equivalents should be understood to encompass a tangible entity, be that an entity that is physically constructed, permanently configured (e.g., hardwired), or temporarily configured (e.g., programmed) to operate in a certain manner or to perform certain operations described herein. Considering embodiments in which the processing element is temporarily configured (e.g., programmed), each of the processing elements need not be configured or instantiated at any one instance in time. For example, where the processing element comprises a general-purpose processor configured using software, the general-purpose processor may be configured as respective different processing elements at different times. Software may accordingly configure the processing element to constitute a particular hardware configuration at one instance of time and to constitute a different hardware configuration at a different instance of time.

Computer hardware components, such as communication elements, memory elements, processing elements, and the like, may provide information to, and receive information from, other computer hardware components. Accordingly, the described computer hardware components may be regarded as being communicatively coupled. Where multiple of such computer hardware components exist contemporaneously, communications may be achieved through signal transmission (e.g., over appropriate circuits and buses) that connect the computer hardware components. In embodiments in which multiple computer hardware components are configured or instantiated at different times, communications between such computer hardware components may be achieved, for example, through the storage and retrieval of information in memory structures to which the multiple computer hardware components have access. For example, one computer hardware component may perform an operation and store the output of that operation in a memory device to which it is communicatively coupled. A further computer hardware component may then, at a later time, access the memory device to retrieve and process the stored output. Computer hardware components may also initiate communications with input or output devices, and may operate on a resource (e.g., a collection of information).

The various operations of example methods described herein may be performed, at least partially, by one or more processing elements that are temporarily configured (e.g., by software) or permanently configured to perform the relevant operations. Whether temporarily or permanently configured, such processing elements may constitute processing element-implemented modules that operate to perform one or more operations or functions. The modules referred to herein may, in some example embodiments, comprise processing element-implemented modules.

Similarly, the methods or routines described herein may be at least partially processing element-implemented. For example, at least some of the operations of a method may be performed by one or more processing elements or processing element-implemented hardware modules. The performance of certain of the operations may be distributed among the one or more processing elements, not only residing within a single machine, but deployed across a number of machines. In some example embodiments, the processing elements may be located in a single location (e.g., within a home environment, an office environment or as a server farm), while in other embodiments the processing elements may be distributed across a number of locations.

Unless specifically stated otherwise, discussions herein using words such as "processing," "computing," "calculating," "determining," "presenting," "displaying," or the like may refer to actions or processes of a machine (e.g., a computer with a processing element and other computer hardware components) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112 (f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention as recited in the claims.

The invention claimed is:

1. A system for unwinding a roll of plastic or paper material, the system comprising:

an unwinding roller for supporting the roll of material;

an idle roller spaced apart from the unwinding roller so that the roll of material can be supported on the idle roller and the unwinding roller;

a first motor in mechanical communication with the unwinding roller and configured to axially rotate the unwinding roller;

a pull roller operable to rotate to pull material from the roll of material;

a second motor in mechanical communication with the pull roller and configured to cause the pull roller to rotate;

a pinch roller operable to rotate with the pull roller;

a biasing element configured to maintain pressure between the pinch roller and the pull roller; and a controller configured to send control signals representative of a desired rotational speed to the first motor, and send control signals representative of a desired torque to the second motor so that a constant linear speed of the material is achieved.

2. The system of claim 1, further comprising a sensor configured to sense a metric representative of a remainder of the material on the roll of material.

3. The system of claim 2, wherein the sensor is configured to send a signal representative of the remainder of the material on the roll of material, and the controller is configured to receive the signal representative of the remainder of the material on the roll of material.

4. The system of claim 1, further comprising— a track extending in a direction parallel to the axis of the unwinding roller;

linear bearings movably coupled to the track; and a platform supporting the idle roller and the unwinding roller and connected to the linear bearings.

5. The system of claim 4, further comprising a linear actuator configured to shift the platform along the track.

* * * * *